US005246138A

United States Patent [19]

Blevins, Jr.

[11] Patent Number: 5,246,138

[45] Date of Patent: Sep. 21, 1993

[54] SLIDING DRAWER SLENDER ARTICLE DISPENSER

[76] Inventor: F. McKinley Blevins, Jr., 819 SE. Madison Blvd., Bartlesville, Okla. 74006

[21] Appl. No.: 812,803

[22] Filed: Dec. 23, 1991

[51] Int. Cl.[5] ..... B65H 3/00

[52] U.S. Cl. ..... 221/191; 221/263

[58] Field of Search ..... 221/152, 186, 191, 287, 221/257, 263, 268; 312/45, 73

[56] References Cited

U.S. PATENT DOCUMENTS 1,246,566 11/1917 Doering et al. ..... 221/268

4,826,041 5/1989 Hunt ..... 221/191

*Primary Examiner*—Robert P. Olszewski

*Assistant Examiner*—Kenneth Noland

[57] ABSTRACT

A linear or non-linear slender article dispenser comprising an open bottom storage box and a cooperating sliding drawer operating across and positioned above the open bottom that is slideable between opposite end limited positions. There is at least one article receiving and holding groove in the upper surface of the drawer; each groove optionally having at least a center opening for gripping said article and preferably, when used with non-linear articles, at each end, an end opening to allow for rotation of the non-linear end of the article resting within the groove and for movement of the article out of the storage box.

16 Claims, 5 Drawing Sheets

SLIDING DRAWER SLENDER ARTICLE DISPENSER

BACKGROUND OF THE INVENTION

This invention relates, in general, to slender article dispensers and, more particularly, to a dispenser with open ended dispensing grooves positioned within the surface of a sliding drawer operating through an open bottom storage box.

PRIOR ART

U.S. Pat. No. 4,826,041 by Hunt teach a tooth pick dispenser having a moveable open bottom storage box, moveable over a rigid stationary base means containing an article dispensing groove.

In dealing with large and possibly heavy linear articles such a drill bits, the movement of- the storage box containing large numbers of articles can prove to be difficult, if not impossible, to move. In the case of dispensing non-linear articles, especially those having tapered ends, the tendency of the articles to jam or wedge would make the movement of the storage box also impossible.

SUMMARY

It is an object of this invention to provide a linear or non-linear slender article dispenser that dispense articles in a non-jamming manner.

It is another objective of the invention to provide a non-linear article receiving groove that accommodates a longitudinal rotation of the article.

It is yet another objective of this invention to provide a compartment partition means that eliminates the wedging or jamming of a tapered non-linear article between the drawer and partition means and also accommodates a longitudinal rotation of the article while in the storage box near the partition's lower edge or in the groove when the groove is positioned near the lower edge of the partition.

It is yet further another objective of this invention to provide a shaped notch in the wall opening for the drawer that eliminates the wedging or jamming of a tapered non-linear article between the drawer and the storage box wall.

It is still yet another objective of the invention to provide a dispenser that is easy to operate when dispensing large or heavy articles.

In accordance with this invention, a dispenser for slender articles comprises: an open bottom article storage box with horizontal openings or slots in a pair opposing walls for receiving a drawer and a flat planar drawer positioned in and slideable through the wall openings, extending across the open bottom and out opposing walls of the box; said drawer provided with a least one groove extending across at least one end of the drawer for receiving an article such that as the drawer is slid into the open bottom area of the box, the groove is positioned in the box to receive a slender article residing therein. Subsequent movement of the drawer out of the box positions the groove and article contained therein to a location outside the box accessible for removal of the article via a gripper receiving opening extending across the groove or channel. An end cut out areas is provided at each end of the groove adjacent the edge of the drawer to provide open area to accommodate rotation of the crooked end of the slender article, when a crooked end article is being dispensed, with the rotation necessary to position the article in the groove in such a manner that it can pass through the walls of the open bottom box to a removal location outside the box in a non-jamming fashion. Optionally, drawer sliding distance stop means and box compartmentalizing means can be present to enhance the operation of the invention.

FIGURES

DETAILED DESCRIPTION OF THE INVENTION

A linear or optionally non-linear slender article dispenser, the article having a width, a length, and optionally a crooked end, comprises a rectangular storage box having walls, a top end, and an open bottom end for the articles, the walls having a thickness, at least one pair of opposing walls being greater in length then the length of the article and the remaining walls being greater in length then the width of the article, the opposing walls further each having a rectangular horizontal opening, the opening having a height and a width, for receiving a drawer, the height of the opening being at least greater then the width of the article and the width of the opening being at least greater then the length of the article, the opening further each having a notch opening in each upper corner surface, the notch opening having a height and a width, for receiving the crooked end of the article, the height of the notch opening and the width of the notch opening each being greater than the width of the article; and a flat planar drawer having a thickness, a width, a length and ends, positioned in and slideable through the horizontal wall openings, the length extending across the open bottom and out each of the opposing walls of the box at least a distance greater than the opposing walls thickness, the width being at least greater than the length of the article, and the thickness being at least greater then the width of the article, the drawer further having at least one article-width-deep groove positioned from at least one drawer end, a distance greater then an opposing wall thickness. The drawer is provide with one or more channels or grooves juxtaposed to one or both ends of the drawer so that as the drawer is moved into the open bottom area of the box, the groove is positioned in the box to receive a slender article therein.

Figure 1:
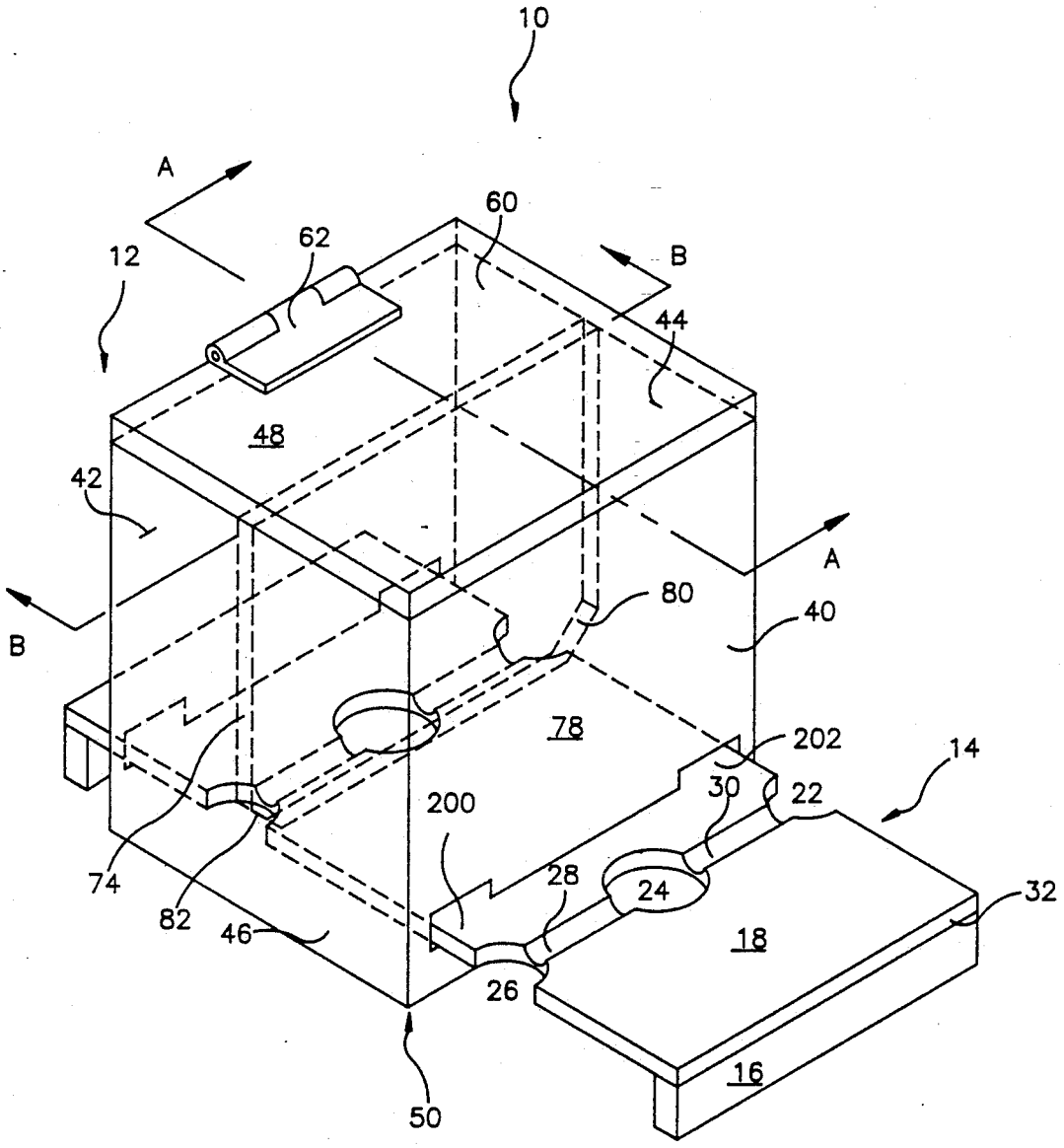
FIG. 1 is a perspective view of the dispenser with the drawer partially open in one direction.
Figure 5:
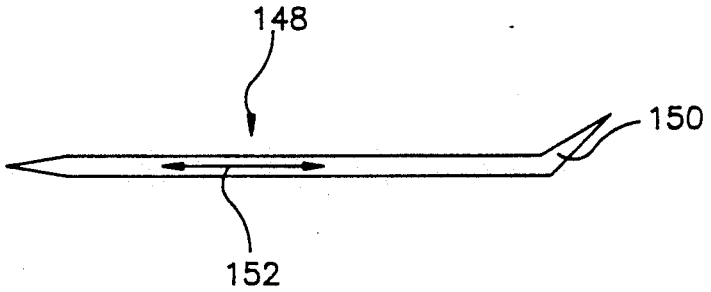
FIG. 5 is a sectional view of a crooked angled toothpick useable in the invention.

There is shown in FIG. 1 at 10 the linear or non-linear slender article dispenser of this invention. Any suitable sized linear slender article such as drill bits, pencils, or toothpicks, or non-linear slender article such as crooked end toothpicks, dental tooth picks, candy canes, etc, may be dispensed by the invention. As illustrative of the non-linear article, FIG. 5 shows a crooked end toothpick 148, having an angled end 150 and longitudinal axis 152 that will be used in the description of the operation of the invention and should not be construed to limit the scope of the invention or articles useful therein. The length of the article is defined as the distance from one end to the opposite end taken on a linear line. The width of the article is defined as the greatest distance between any pair of longitudinal walls. The dispenser 10 comprises two principle parts; an open bottom box 12 and a sliding drawer 14. Any multisided box can be used in the invention, with an even number sided box being preferred and a rectangular box being most preferred. The invention is described in terms of a rectangular storage box. The storage box and drawer can be made of any rigid formable material such as wood or plastic but preferably is made of high impact, rigid, transparent plastic. Plastics, such as acrylic styrene, polycarbonate, or butadiene styrene copolymers are very effective for construction of the dispenser.

Figure 2:
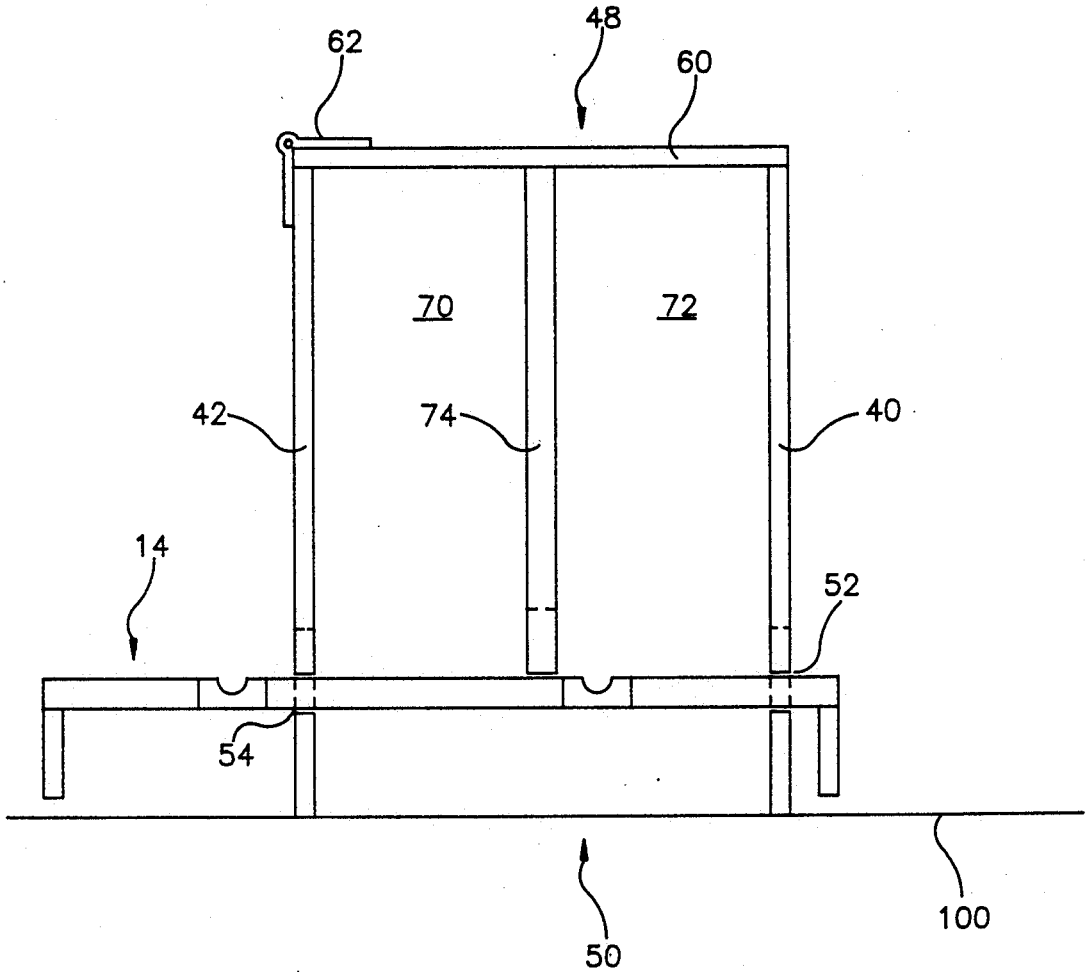
FIG. 2 is a sectional view taken along line A—A of FIG. 1.
Figure 3:
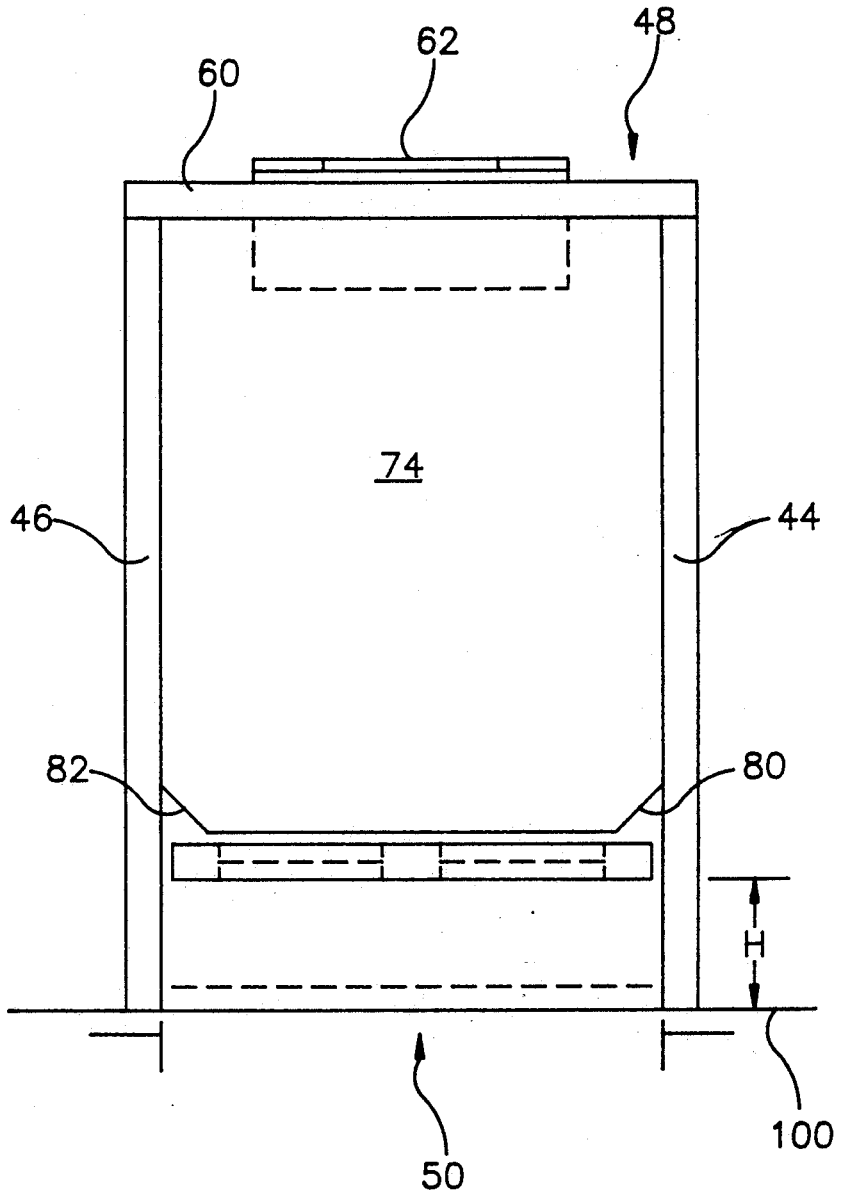
FIG. 3 is a cut away and sectional view taken along line B—B of FIG. 1.

As shown in FIG. 1, the box 12 has walls 40, 42, 43, and 44, a top end 48, and an open bottom 50, the length of the walls applicable to the article being dispensed, that is the length of a pair of opposing wall, such as walls 40 and 42, are at least greater than the length of the article and the length of the remaining walls, such as walls 44 and 46 are at least greater than the width of the article. The length of a wall is defined as the distance between two adjoining walls. With the length of the remaining walls less than the length of the article, the articles will remains oriented parallel to the opposing two walls. The height of the walls not being limited and being sized as desired for the number of articles desired to be stored. The opposing walls or sides are designated the front and back sides and the remaining walls or sides are designated the left and right side, in either case the wall names within a pair being interchangeable. The rectangular box 12 comprises a front side 40, a back side 42, a right side 44, a left side 46, a top end 48, and an open bottom end 50. The front side 40 and back side 42 each have a horizontal slot or opening 52 and 54 respectively, best seen in FIG. 2, therethrough for receiving and allowing slide through of drawer 14. Said slots can be of any shape that still accomplishes the thrust of the invention of transferring the article to the outside of the storage box in a non-jamming easy manner. Preferable the slot is of a rectangular configuration having a width and a height, best seen in FIG. 3, said width being the distance between right side 44 and the left side 46 of box 12 and having a distance at least greater than the length of the article. The height is the distance of the opening between the bottom end 50 and top end 48 of the box, said height being at least greater than the width of the article. Said openings are also positioned on the front side 40 and back side 42 at sufficient height H, as seen in FIG. 3, above the open bottom 50 to allow movement of the drawer 14 through said slots 52 and 54 while the box rests immobile on some underlying surface 100. In the preferred embodiment of the invention, the back side 42 with opening or slot 54 is a mirror image of the front side 40 with slot or opening 52. When the non-linear slender article has a tapered or pointed end configuration, such as in the case of the toothpick, notch or shape openings 200 and 202, best seen in FIG. 1, are cut in the upper surface of wall opening 52 and as stated for a mirror image, in the upper surface of wall opening 54. The notch or shape openings having a height and width, are of such a size that the crooked end of the slender article residing in the storage box on top of the drawer surface 37, can reside therein but small enough that the longitudinal length of the article doesn't pass through when lined up parallel with the slotted walls 40 and 42 of the storage box. Therefore, the width and height of the shaped openings are at least greater then the width of the article. With the notch or shape openings present, the tapered or wedge-shaped end of the non-linear article does not wedge between the upper surface of slot 52 or 54 and the upper surface 37 of drawer 14 when the drawer is moved into and out of the box. The drawer can operate in a non-jamming manner.

The left side 46 and the right side 44 are solid wall means that provide the other two sides of the storage box 12. The walls of the box 12 each also have a thickness.

The top 48 of the storage box comprises a closure means 60 attached to cover the opening made by the four sides 40, 42, 44, and 46 of box 12. Said closure mean 60 also of a rigid material similar to the box material is positioned either on or within the opening formed by the four walls and is attached by any mechanism or means 62 such as a hinge, well known in the art. For example, said closure means 60 might comprise a flat rectangular plate that slides into grooves in opposing walls of said box these walls extending slightly above the other two walls for positioning the grooves thereon optionally with removal preventing means placed on the underside of said rectangular plate; said closure means 60 might snap over the opening in the top of the box, being held in place by tension or pressure means rigidly attached to the closure and retainingly pressing outward against the interior opposing sides of the box; or as shown in FIGS. 1, 2, and 3, the closure means 60 might be pivotally attached along one side by means of a hinge 62 well known in the art.

Figure 4:
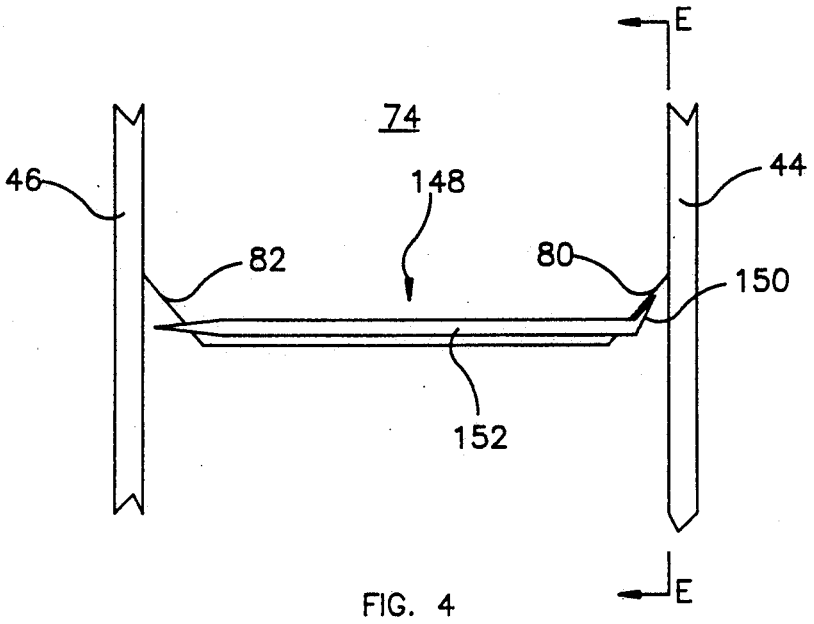
FIG. 4 is a fragmentary sectional view of the bottom of the partition with a toothpick positioned in front of the partition and without the drawer also taken in the direction indicated by line B—B of FIG. 1.

Optionally but preferred, said box can be divided into compartments 70 and 72 by partition means 74. It is desirable for the open bottom box 12 to be divided into two compartments 70 and 72 by the presence of partition means 74 extending vertically and parallel to the front side 40 and back side 42 of box 12 so that the dispenser can be operated from either direction as will be explained later. The partition 74 extends between right side 44, left side 46, top 48, and downward a distance so that the bottom edge of partition 74 would set just above a plane that would be formed by a surface extending between the top of the opposing slots 52 and 54 of sides 40 and 42 if said surface did exist. In other words, the partition 74 extends downwards a distance slightly less then the distance either slot 52 or 54 is from the top 48 of box 12. The partition 74 extends downward on but not contacting the upper surface 37 of the drawer so as to keep the compartments separated. The partition's main function is to provide a compartment shape that tends to line up the slender articles 148 in parallel relationship to each other and to the grooves 28 and 30 in the drawer 14. This aligning promotes smooth operation of the dispenser by encouraging feeding of the articles into the grooves 28 and 30. The partition width or sideways extends a distance equal to the distance between the right side 44 and the left side 46 so as to contact and, if desired, seal to the left side 46 and the right side 44 of box 12. The partition 74 is preferably the same shape as the front wall section 78 of the front side 40 between side walls 44 and 46, above slot 52 and below top 48, with the exceptions of the lower right corner 80 and the lower left corner 82 of the partition 74, as best seen in FIG. 3. These normally envisioned square lower edge corners are, as shown in FIGS. 3 and 4, angularly or shaped cut out openings of such a shape as to allow passage through of the non-linear end of the slender article. The cut out openings having a height and a width, are preferably desired so as to prevent the pointed or tapered end of the non-linear article, if present, from wedging between the partition 74 bottom edge and the upper surface 37 of the drawer 14. They perform similar functions as the notch openings 200 and 202 in the front wall 40. The height and the width of the shaped cut out opening is at least greater than the width of the article. The shaped cut out openings can also be designed such that the crooked end 150 of the non-linear article 148 can pass therethrough when said article is rotated along its longitudinal axis. The angular or shaped cut out openings or portions 82 and 80 of partition 74 are of such a design so as to allow the non-linear end of the slender article to pass through to also assist with rotation of the article as will be described later. As seen in FIG. 1, a preferred triangular shape is shown with the angle the hypotenuse of the triangle makes with one side (in this case the bottom of the partition) of the triangle being equal to the angle the crooked end of the toothpick makes with its longitudinal axis. The triangle is sized so that with the toothpick non-crooked end touching the side of storage box 12, the crooked end 150 will still move or pass through the triangular cut out areas 80 and 82 of partition 74. In a second embodiment such as to use with a candy cane, a fairly large quarter circle shape might be cut from corners 80 and 82. Also for smooth operation of the invention as for reasons just explained, the width of box 12 i.e. the distance between walls 44 and 46, should be only slightly longer but at least greater than the end to end length of the slender article.

The drawer 14 having a width, a length, a thickness and ends, as best seen in FIG. 1, can be of any flat planar end-view-cross-sectional shape that will still slide through the wall openings of the box. In the preferred embodiment, the drawer has a flat planar rectangular cross sectional shape in the short side direction, the end view direction, identical to the shape of the rectangular openings 52 and 54 in the box front and back sides 40 and 42, respectively and a size slightly smaller then the size of the openings and is positioned through the openings 52 and 54 so as to extend across the open bottom 50 of the box 12 and outwards from both the front 4 and back 42 sides of the box. The length of the drawer extends out each opening of the walls at least a distance greater than the thickness of the walls. Preferably, the drawer extends out each opening of the walls a distance equal to the width of the box open bottom or the width of its respective compartment, if present, the width being defined here as the distance between the front and back walls of the box. The width of the drawer is at least greater than the length of the article and the thickness of the drawer is at least greater than the width of the article. Optionally the flat plane 18 of the drawer 14 can have depending skirts 16 (extending either upwards or downwards) at each end thereof useful for a variety of means. In the downward direction, it provides an additional support means to discourage tipping of the dispenser or as a depending skirt stop means for the drawer movement in and out of the box so as to prevent complete removal of the drawer from the wall openings. In the upward direction, the skirt can be used as a handle to assist in movement of the drawer.

Figure 7:
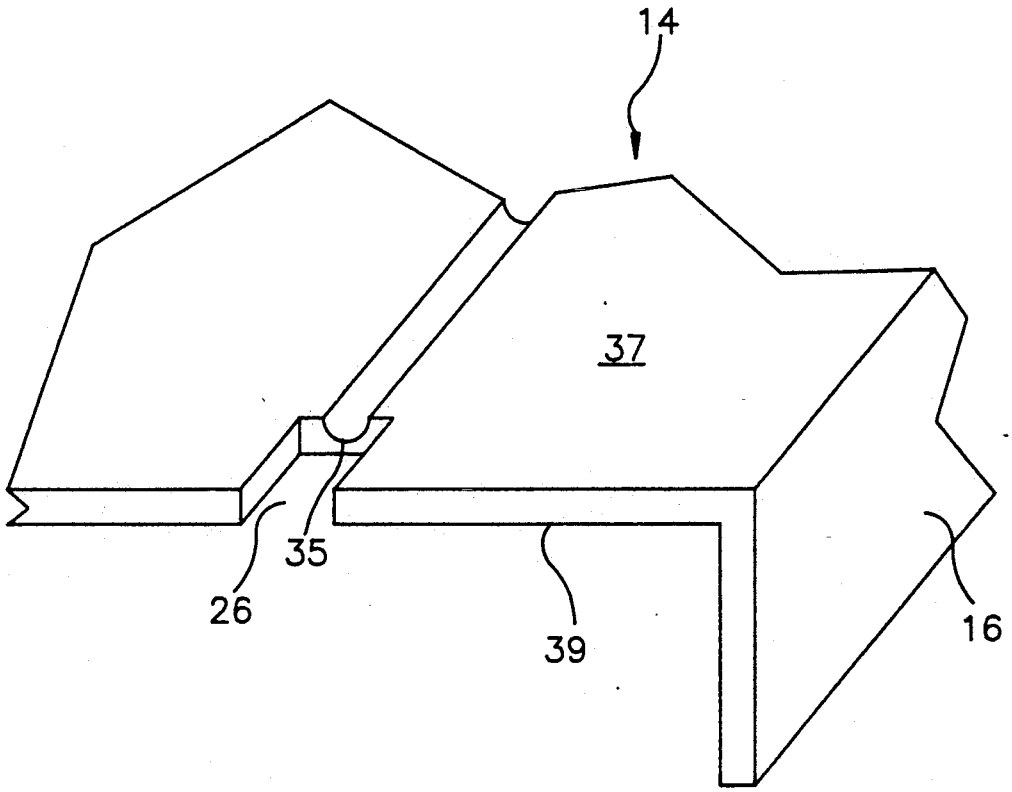
FIG. 7 is a fragmentary sectional edge view of one end of the drawer.

Within the plane 18 of the drawer 14, there is an article receiving or holding groove extending across the short side or width of the drawer. Also within the plane 18 of the drawer 14, when dispensing crooked end articles and to ease the removal of the article from the groove, there optionally are two shaped cut out areas 22 and 26 and third cut out hole or bowl 24, in a linear relationship to each other and the groove, across the short side width of the drawer 14, with cut out hole 24 centered in the width of the drawer 14 and left shaped cut out area 22 and right shaped cut out area 26 being made at opposing edges of the drawer 14. The center cut out hole divides the groove into a pair of grooves, left groove 28 and right groove 30 connecting cut out areas 26 and 22, respectively, with cut out hole 24, said pair of groove also lying in line with the linear relationship of the three cuts. The center line of the cuts and the centerline of the groove fall on the same line with each other and can be parallel with the front edge 32 of the drawer for cosmetic reasons which in turn can be parallel with the front side 40 of the box 12. While in actual practice, the front edge 32 of the drawer does not have to be parallel with the center line of the cuts, the groove and front side 40, it is necessary that the center line of the cuts, the groove and front side 40 be parallel for operation of the invention. The center opening or hole 24 provides clearance around the longitudinal axis 152 of the article for the grasping and removal of the article from the drawer. The opening 24 may be any shape that allows for entrance of the grasping means, such as a bowl, with a round shape hole being more preferred for human fingers. Similarly the shaped cut out areas 22 and 24 may be any shape that allows the crooked end of the article to lie therein, with a semicircular shape being preferred. In a second embodiment, the cut out areas 22 and 26, and the cut 24 could be bowl shaped indentions and still accomplish the scope of the invention. In a third embodiment, the cutout 24 could be a groove shaped slot extending the entire length of the drawer and still accomplish the scope of the invention. The shaped cut out areas 22 and 26 can be, but not required to be, similar in shape to the shaped cut out openings 80 and 82 of partition 74 which ar shaped to receive and/or allow passage therethrough of the non-linear end 150 of the slender article. The non-linear end 150 of the slender article 148 must extend into or over the cut out areas 22 and 26 of the drawer even when the non-crooked end is against the wall of the box. In other words the cut out area 22 and 26 must be large enough and extend toward the center of the drawer far enough that the crooked end 150 of the slender article is over or in the cut out areas 22 and 26 at all times and in all positions when the article 148 resides in the grooves 28 and 30. The cut out area 22 or 26 can be described as a volume when the shape is such that shaped cut out area extends through the drawer, the volume being defined by the area enclosed by the drawer cut out area wall, the missing upper and lower surface of the drawer and the missing outer edge of the drawer. When the cut out areas 22 and 26 are bowl shaped, they form a semicircular bowl shape, the volume is the volume of the bowl section residing in the drawer plane. The grooves 28 and 30, when viewed edge on, as shown in FIG. 7, have a rounded bottom 35 cross sectionally shape that will allow for rotation of the article as it resides in the grooves. As can be seen in FIG. 7, and necessary for holding the article, the thickness of the drawer 14 and the depth of the grooves 28 and 30 must be of different sizes so that the groove depth does not cut the drawer in half but is of sufficient depth that it will retain the slender article 150 and such that all of the diameter of the article's longitudinal axis 152, also called the width of the article, when located in the grooves 28 and 30 is positioned between the upper surface 37 and lower surface 38 of the drawer 14. The thickness of the drawer is at least greater than the width of the article for the above reason. For the same reason, an article-width-deep groove is envisioned in the practice of the invention. In other words, the article 148 is located within the drawer. This is necessary so as to allow the drawer 14 to transfer the article 148 from the interior such as compartment 72, of the box 12 to the outside of the box 12 through the wall openings 52 and 54 in the sides 40 and 42 of the box 12 in a smooth non-jamming manner. If the article extended above the surface, it would hit or hang on the openings 52 and 54 upper surfaces as the drawer 14 passes through to the outside of the box 12. A close fit of the drawer 14 within the slots 52 and 54 is necessary to keep dirt and other objects from entering the box, to retain the articles in the box, and to assist in allowing only one article at a time, to be removed. This close fit can cause the non-linear article to jam at the slots when being removed due to their crooked end 150 if it were not for the cut out areas 22 and 26 in the drawer 14 and notch openings 200 and 202 on the wall openings 52 and 54 in the walls 40 and 42 of the invention that allows for rotation of the article into the plane and below the surface of the drawer and for movement of the tapered crooked end there into, in a non-wedging manner, respectively.

As with the partition cut out openings 80 and 82, the drawer 14 edge cut out areas 22 and 26 can be of any shape or size, said shape or size more or less defined by the shape of the nonlinear end of the slender article.

Figure 6:
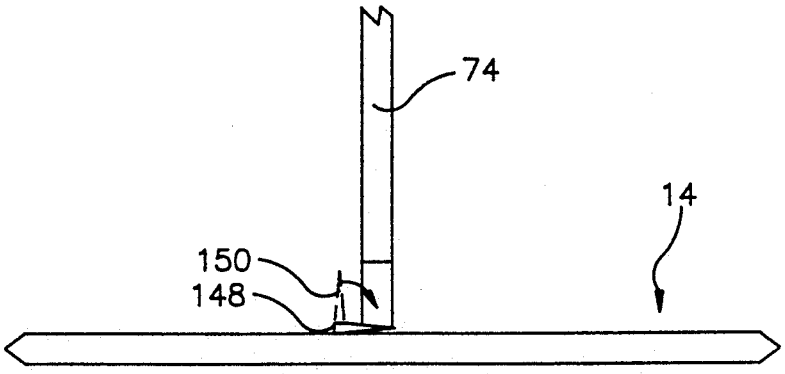
FIG. 6 is a fragmentary sectional end view of the partition and toothpick taken along line E—E of FIG. 4.

The drawer groove or grooves 28 and 30, when present are positioned on the drawer 14 from at least one end of the drawer at least a distance greater than an opposing wall thickness. In the instant embodiment, the groove is positioned a distance from the end of the drawer equal to the sum of the thickness of an opposing wall and the width of the compartment into which it will reside when insert into the box with the length of drawer being equal to sum of twice an opposing wall thickness and twice the width or distance between the opposing walls of the box. In this position when the drawer is pushed fully into the box 12 (up to the stop means 16, the stop means thickness being added to both distances mentioned above, if present), the grooves' inner most or farthest-away-from-the-drawer-end edge is located just inside the compartment 72 at the interior edge of the partition 74. In this manner the groove or grooves 28 and 30 are located so that all articles in the compartment can be removed, that is the grooves 28 and 30 in the drawer can moved to any location in the compartments open bottom. Also at this location, the drawer edge cut out areas are beneath the partition corner cut out openings, leaving an open space or area in which the crooked end of the slender article can move or rotate unobstructively or in which a tapered or pointed end of the slender article can enter without causing the article to wedge between the drawer and the partition. With this length of the drawer, i.e. the distance from skirted end to skirted end if present, when the drawer is fully withdrawn (pulled out to the stop means, if present), the grooves 28 and 30, cuts 22, 24, and 26, and resident article are fully outside the box 12. With the grooves 28 and 30 and cut outs 22, 24, and 26 within the compartment 72, a slender article 148, also within the compartment 72, can fall into the grooves. Initially when the article enters the grooves and cut our areas, the non-linear end 150 of the article can be oriented in either direction and at any angle around the longitudinal axis. With the article resting in the drawer grooves 28 and 30 and cut outs 22, 24, and 26, with either end arbitrarily directed, the drawer 14 is moved in direction that will move the grooves and article out of the storage box 12. As the drawer moves, the crooked end 150 of the article 148 is rotated around its longitudinal axis 152 by gravity or the interference with other slender articles above the one in the grooves or by the interior of the front wall 40 of the box 12, into the plane of the drawer, in particular, into the cut out areas 22 and 26 of the drawer edges, based on which direction the end is oriented. The rotational motion is also encouraged by the retaining mechanism of the straight vertical walls of the grooves 28 and 30 on the longitudinal axis 152 of the article 148. The rounded bottom 35 of the grooves encourage rotation around the longitudinal axis while the length of the grooves 28 and 30 discourages rotation around the lateral axis, not shown, which would be perpendicular to the longitudinal axis 152. As illustrative of the rotation of the article, FIG. 6 is an end view of a toothpick looking at the crooked end 150 which is lying in side by proximity with the partition 74 also seen edge on. Arrow C shows the type of pivotal (rotational) motion of the toothpick around the longitudinal axis necessary for the article to orient itself for operation of the invention. With the article positioned below the upper surface 37 and lower surface 38 of drawer 14, the drawer 14, grooves 28 and 30, and article 148 pass through the openings 52 or 54 of the front wall 40 or rear wall 42, respectively, to the outside of the box 12 for removal of the article. As mentioned earlier, for the drawer to be operated from either direction, i.e. facing the front wall 40 or facing the rear wall 42, a second groove can be positioned at the opposing end of the drawer for receiving an article. The groove and associated cut outs can be similar to the first groove for dispensing like articles or different for dispensing dissimilar articles. Preferred a complimentary or mirror image pair of grooves and cut out areas similar to grooves 28 and 30 and cut out areas 22, 24, and 26, are located at a similar distance from the opposite end of the drawer. In this situation, the length of the drawer is such that when either side is pushed all the way in, the opposing side (the cut outs and grooves) are fully outside the box of removal of the article. All dimensions of the box, drawer, and the cut areas are variable and dependent on the size and shape of the article being dispensed. For example, the width of the box 12, the distance between walls 44 and 46 is only slightly longer then the end to end length of the article to eliminate sliding of the article along its longitudinal axis 152 within the box. Said sliding would result in the crooked end 150 of the slender article moving away from the corner cut out openings 80 and 82 of the partition and the edge cut outs 22 and 26 of the drawer into an unacceptable position next to the solid part of partition 74 and solid part of the drawer 14. Location of the article in this position in reference to the solid parts of the partition and drawer, would not allow for the rotational motion of the article that would position it within the drawer and thus allow the smooth non-jamming operation of the invention. This rotation is desired at the partition wall as well as at other locations in the storage box. For articles linear in construction, those not having crooked ends 150, the cut out openings 80 and 82 in partition 74, cut outs 22 and 26 in drawer 14 and notch openings 200 and 202 in front wall 40, as well as their mirror image cut outs, can be eliminated for non-jamming operation of the invention and without departing from the scope of the invention.

Where as this invention has been described with respect to several embodiments thereof, it should be realized that various changes may be made without departing from the essential contributions to the art made by the teaching hereof.

What is claimed:

1. A dispenser for slender articles, the article having a length, a width, and optionally a crooked end, having:

an open bottom storage box for the articles, the box having a horizontal rectangular opening in a pair of opposing walls for receiving a drawer and a partition positioned above the drawer and parallel with the walls containing the openings, the partition further having a shaped cut out opening at each lower corner, whereby the partition divides the box into compartments; and a rectangular flat planar drawer having ends, positioned in and slideable through the wall openings, extending across the open bottom and out the opposing walls of the box, the drawer further having at least one groove extending across at least one end of the drawer for receiving the article, whereby the groove is moved into and out of the box by a sliding action of the drawer.

2. A dispenser of claim 1, wherein the wall openings have a notch opening above each upper corner for receiving the crooked end of the article in a non-jamming manner.

3. A dispenser of claim 1, wherein the groove has a shaped cut out area at each end thereof wherein the crooked end of the article can reside.

4. A dispenser of claim 1, wherein the drawer has a second groove positioned at an opposing end of the drawer for receiving an article, whereby movement of one groove into the box results in movement of the opposing groove out of the box.

5. A dispenser for slender articles, the article having a length, a width, and optionally a crooked end, having:

a rectangular storage box having walls, a top end, and an open bottom end for the articles, the walls having a thickness, at least one pair of opposing walls being greater in length then the length of the article and the remaining walls being greater in length then the width of the article, the opposing walls further each having a rectangular horizontal opening, the opening having a height and a width, for receiving a drawer, the height of the opening being at least greater then the width of the article and the width of the opening being at least greater then the length of the article, the opening further each having a notch opening in each upper corner surface, the notch opening having a height and a width, for receiving the crooked end of the article, the height of the notch opening and the width of the notch opening each being greater than the width of the article; and a flat planar drawer having a thickness, a width, a length and ends, positioned in and slideable through the horizontal wall openings, the length extending across the open bottom and out each of the opposing walls of the box at least a distance greater than the opposing walls thickness, the width being at least greater than the length of the article, and the thickness being at least greater then the width of the article, the drawer further having at least one article-width-deep groove positioned from at least one drawer end, a distance greater then an opposing wall thickness.

6. A dispenser of claim 5, including a partition positioned vertically and parallel with the opposing walls and on, but not contacting, the surface of the drawer; the partition further having a shaped cut out opening, at each lower corner, the cut out opening having a height and a width, the height and width each being at least greater then the width of the article, whereby the partition divides the box into compartments.

7. A dispenser of claim 5, wherein the groove has a shaped cut out area at each end thereof, the cut out area having a width, a height, and a length, the width, the height, and the length being such that the crooked end of the article can reside therein.

8. A dispenser of claim 5, including a depending skirt stop means attached to each end of the drawer whereby the drawer is prevented from complete removal from the wall openings.

9. A dispenser of claim 5, wherein the box has a closure means at the top end of the box.

10. A dispenser of claim 5, wherein the box and the drawer are of a transparent, rigid, formable plastic.

11. A dispenser of claim 5, wherein the drawer has a second groove positioned at an opposing end of the drawer for an article, whereby movement of one groove into the box results in movement of the opposing groove out of the box.

12. A dispenser of claim 5, wherein the article is a crooked toothpick.

13. A dispenser of claim 5, wherein the notch openings are rectangular in shape.

14. A dispenser of claim 6, wherein the shaped cut out openings are triangular in shape.

15. A dispenser of claim 7, wherein the shaped cut out areas are semicircular in shape.

16. A dispenser of claim 5, wherein the groove has a central hole through the drawer for removal of the article.

* * * * *